US010534283B2

(12) United States Patent
Yoshiyama et al.

(10) Patent No.: US 10,534,283 B2
(45) Date of Patent: Jan. 14, 2020

(54) IMAGE FORMING APPARATUS, IMAGE FORMING APPARATUS CONTROL METHOD, AND IMAGE FORMING APPARATUS CONTROL PROGRAM

(71) Applicant: KONICA MINOLTA, INC., Chiyoda-ku, Tokyo (JP)

(72) Inventors: Tsugihito Yoshiyama, Toyohashi (JP); Hokuto Hatano, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/212,665

(22) Filed: Dec. 6, 2018

(65) Prior Publication Data

US 2019/0187580 A1 Jun. 20, 2019

(30) Foreign Application Priority Data

Dec. 18, 2017 (JP) ..... 2017-241605

(51) Int. Cl.
*G03G 15/02* (2006.01)
*G03G 15/00* (2006.01)

(52) U.S. Cl.
CPC ..... *G03G 15/0233* (2013.01); *G03G 15/5004* (2013.01); *G03G 15/80* (2013.01)

(58) Field of Classification Search
CPC ..... G03G 15/55; G03G 15/0216; G03G 15/0233; G03G 15/0258; G03G 15/553
See application file for complete search history.

(56) References Cited

U.S. PATENT DOCUMENTS

2014/0064751 A1* 3/2014 Kuroiwa ..... G03G 15/55 399/31
2017/0244858 A1* 8/2017 Udaka ..... G03G 15/50
2018/0335715 A1* 11/2018 Tomiie ..... G03G 15/0266

FOREIGN PATENT DOCUMENTS

JP H08152766 A 6/1996
JP H10133456 A 5/1998
JP H1184829 A 3/1999

* cited by examiner

*Primary Examiner* — Thomas S Giampaolo, II
(74) *Attorney, Agent, or Firm* — Holtz, Holtz & Volek PC

(57) ABSTRACT

An image forming apparatus includes: an image carrier; a charging roller that charges the image carrier; a power supply part that applies a charging voltage to the charging roller; a current measurement part that measures a value of a DC component of a current flowing between the image carrier and the charging roller at at least two timings having mutually different elapsed times; and a hardware processor that measures an elapsed time from a start of application of the charging voltage by the power supply part, calculates a coefficient of an approximate expression indicating a relationship between the value of the DC component of the current flowing between the image carrier and the charging roller, and the elapsed time, and performs judgment related to life of the charging roller on the basis of the coefficient and a predetermined threshold.

14 Claims, 13 Drawing Sheets

1

IMAGE FORMING APPARATUS, IMAGE FORMING APPARATUS CONTROL METHOD, AND IMAGE FORMING APPARATUS CONTROL PROGRAM

The entire disclosure of Japanese patent Application No. 2017-241605, filed on Dec. 18, 2017, is incorporated herein by reference in its entirety.

BACKGROUND

Technological Field

The present invention relates to an image forming apparatus, an image forming apparatus control method, and an image forming apparatus control program. More specifically, the present invention relates to an image forming apparatus that performs judgment on the life of a charging roller, a method for controlling the image forming apparatus, and a control program for the image forming apparatus.

Description of the Related Art

An electrophotographic image forming apparatus includes: a multi function peripheral (MFP) having a scanner function, a facsimile function, a copying function, a printer function, a data communication function, and a server function; a facsimile machine; a copying machine; and a printer.

Generally, an image forming apparatus forms a toner image by developing an electrostatic latent image formed on a photoreceptor with a developing apparatus, transfers the toner image to a sheet, and fixes the toner image onto the sheet by using a fixing device to form an image on the sheet. In addition, a certain image forming apparatus develops an electrostatic latent image on a surface of the photoreceptor by the developing apparatus to form a toner image, transfers the toner image to the intermediate transfer belt by using a primary transfer roller, and performs secondary transfer of the toner image on the intermediate transfer belt onto a sheet using a secondary transfer roller.

The electrostatic latent image on the photoreceptor is formed by charging the surface of the photoreceptor and patterning an electrostatic latent image on an exposure apparatus. Electrophotographic charging methods include a corona discharge method and a contact discharge method. Among them, the contact discharge method is a charging method in which a charging roller being a roller-shaped semiconductive charging member is disposed in contact with or in close proximity to the surface of the photoreceptor, and then, charging voltage is applied to the charging roller to perform proximity discharge to apply charge to the surface of the photoreceptor. The contact discharge method has an advantage of being able to reduce the generation of oxides (ozone or the like) caused by high voltage current flowing through the air. In addition, the contact charging method has advantages of being able to achieve a small ozone generation amount, a reduction in size of the apparatus configuration, and a reduction in charging current, or the like.

The contact charging method is further divided into: a direct current (DC) charging method using simply a DC voltage as a charging voltage applied to the charging roller; and an alternating current (AC) charging method using a voltage obtained by superimposing an AC component on a DC component, as a charging voltage applied to the charging roller.

In the AC charging method, discharge and static charge removal between the charging roller and the photoreceptor are forcibly repeated by the AC component. This makes the AC charging method advantageous in having higher charging capability and higher uniformity of the potential of the surface of the photoreceptor after charging, as compared with the DC charging method. In addition, the AC charging method has an advantage that the uniformity of development can be enhanced.

In a case where the charging roller or a unit including the charging roller is used for a longer period than usual, the charging performance of the charging roller is likely to deteriorate.

FIG. 16 is a diagram schematically illustrating a relationship between a running distance of the charging roller and a surface potential of the photoreceptor in a case where the charging voltage applied to the charging roller is constant.

Referring to FIG. 16, the more the running distance (use period) of the charging roller, the lower the surface potential of the photoreceptor and charging performance. This is estimated to be occurring for the following reason. The increase in the use period of the charging roller leads to formation of a trap site that traps a charge or a portion that inhibits the movement of the charge inside and on the surface of the charging roller. In a case where the charging voltage is applied to the charging roller, a portion of the charge moving through the charging roller due to the influence of an electric field formed by the charging voltage would be captured by this trapping site or inhibited from moving. This reduces the charge moving on the charging roller and hinders smooth flow of the discharge current between the charging roller and the photoreceptor, leading to the surface potential of the photoreceptor lower than a target surface potential.

Deterioration of the charging performance of the charging roller described above would be a problem particularly in an image forming apparatus having a long life. This led to the necessary to accurately judge the life of the charging roller. Conventional techniques for judging the life of the charging roller are disclosed in JP 11-084829 A, JP 10-133456 A, and JP 08-152766, for example.

JP 11-084829 A discloses a technique in which a charging roller is brought into contact with a contamination detection roller unit so as to detect a current flowing through an electrode roller of the contamination detection roller, thereby detecting contamination on the surface of the charging roller.

JP 10-133456 A discloses a method in which a life detection member is brought into contact with a charging roller so that a current value flowing through the charging roller is measured with an ammeter and the life of the charging roller is judged on the basis of the measured current value.

In the technique disclosed in JP 08-152766 A, in a case where the charging current (DC component) flowing at strong exposure is a prescribed value or less, it is judged that occurrence of resistance increase in the charging member due to contamination of the charging member or the like hinders flow of necessary charging current and the life of the charging member is notified.

The techniques of JP 11-084829 A and JP 10-133456 A, however, have a problem that leaving a conductive member for measuring the current in contact with the charging roller might cause a current to flow in the conductive member in a case where the charging voltage is applied to the charging roller, hindering the flow of a discharge current necessary for the photoreceptor. In addition, an unnecessary current might flow through the photoreceptor at the time of detection of the life of the charging roller, hindering correct measurement of the current flowing through the charging roller. In order to avoid these situations, there is a need to provide a mechanism for switching the state of the charging roller between the state in which the charging roller is in contact with the photoreceptor and the state in which the charging roller is separated from the photoreceptor, depending on whether the photoreceptor is being charged or the life is being detected. Alternatively, there is a need to provide a mechanism for switching the state of the conductive member between a state in which the conductive member is in contact with the charging roller and a state in which the conductive member is separated from the charging roller. This leads to a problem of complicating the configuration for detecting the life of the charging roller and enlarging the size of the image forming apparatus.

A technique disclosed in JP 08-152766 A also has a problem as follows. While an organic photoreceptor is generally used as a photoreceptor in an electrophotographic apparatus, the organic photoreceptor is scraped with use and the film thickness decreases. The charging current value necessary for proper charging depends on the film thickness of the photoreceptor. This leads to a problem of difficulty in accurately prescribing a charging current value necessary for proper charging in a photoreceptor such as an organic photoreceptor of a type in which the film thickness is reduced by use, resulting in low accuracy in judging life of the charging roller.

Specifically, in a case where the photoreceptor is scraped to reduce the film thickness, the charging current value necessary for charging the surface of the photoreceptor to a predetermined surface potential is higher than a charging current value at the initial stage of use, in inverse proportion to the film thickness. Therefore, the surface potential of the photoreceptor decreases as compared with the initial stage of use even when the charging current value is the same value as in the initial stage of use. This would result in continuous use of the charging roller which has already reached its end of life, causing fogging, which is a phenomenon in which toner adheres to the non-image portion with higher density.

SUMMARY

The present invention is made to solve this problem and aims to provide an image forming apparatus, an image forming apparatus control method, and an image forming apparatus control program, capable of enhancing the accuracy of judging the life of a charging roller while suppressing an increase in the size of an apparatus configuration.

To achieve the abovementioned object, according to an aspect of the present invention, an image forming apparatus reflecting one aspect of the present invention comprises: an image carrier; a charging roller that charges the image carrier; a power supply part that applies a charging voltage to the charging roller; a current measurement part that measures a value of a DC component of a current flowing between the image carrier and the charging roller at at least two timings having mutually different elapsed times; and a hardware processor that measures an elapsed time from a start of application of the charging voltage by the power supply part, calculates a coefficient of an approximate expression indicating a relationship between the value of the DC component of the current flowing between the image carrier and the charging roller, and the elapsed time, on the basis of the value measured by the current measurement part and the elapsed time at measurement performed by the current measurement part, and performs judgment related to life of the charging roller on the basis of the coefficient and a predetermined threshold.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

The following embodiment describes a case where the image forming apparatus is an MFP. The image forming apparatus may be a facsimile machine, a copying machine, a printer, or the like, in addition to the MFP. The image forming apparatus may be of any type as long as it forms an image by an electrophotographic method, an electrostatic recording method, or the like.

First Embodiment

First, a configuration of an image forming apparatus according to the present embodiment will be described.

Figure 1:
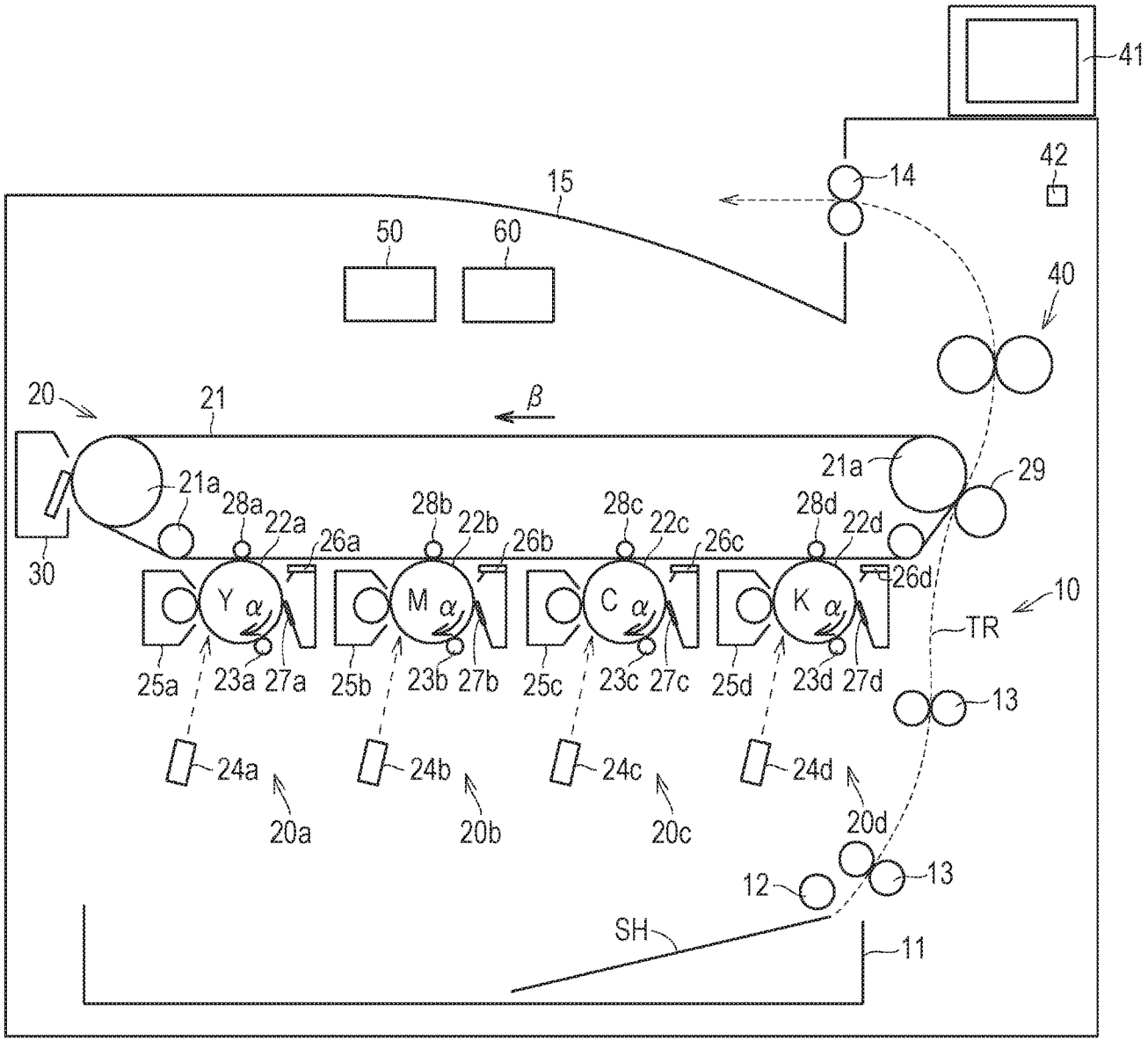
FIG. 1 is a cross-sectional view illustrating a configuration of an image forming apparatus according to a first embodiment of the present invention.

FIG. 1 is a cross-sectional view illustrating a configuration of an image forming apparatus 1 according to a first embodiment of the present invention.

Referring to FIG. 1, the image forming apparatus 1 in the present embodiment is a tandem color image forming apparatus, and prints a full color image or a monochrome image on a sheet SH. The image forming apparatus 1 mainly includes a sheet conveyer 10, a toner image forming unit 20, a fixing apparatus 40, an operation panel 41, a temperature and humidity sensor 42 (an example of a state obtaining part), a bias power supply 50, and a control unit 60.

The sheet conveyer 10 includes a sheet feed tray 11, a sheet feed roller 12, a plurality of conveyance rollers 13, a sheet discharge roller 14, and a sheet discharge tray 15. The sheet feed tray 11 accommodates sheets SH for forming an image. A plurality of the sheet feed trays 11 may be provided. The sheet feed roller 12 is arranged between the sheet feed tray 11 and a conveyance path TR. Each of the plurality of conveyance rollers 13 is arranged along the conveyance path TR. The sheet discharge roller 14 is provided at the most downstream portion of the conveyance path TR. The sheet discharge tray 15 is provided at the uppermost portion of a main body of the image forming apparatus.

The toner image forming unit 20 combines images of four colors of yellow (Y), magenta (M), cyan (C), and black (K) by a tandem system to transfer a toner image on the sheet SH. The toner image forming unit 20 includes image forming units 20*a*, 20*b*, 20*c*, and 20*d* for Y, M, C, and K colors, an intermediate transfer member 21, a secondary transfer roller 29, and an intermediate transfer member cleaning device 30.

The image forming unit 20*a* for Y includes a photoreceptor 22*a*, a charging roller 23*a*, an exposure apparatus 24*a*, a developing apparatus 25*a*, a static charge removal device 26*a*, a photoreceptor cleaning device 27*a*, and a primary transfer roller 28*a*.

The photoreceptor 22*a* is rotationally driven in a direction indicated by an arrow α in FIG. 1. The charging roller 23*a*, the exposure apparatus 24*a*, the developing apparatus 25*a*, a primary transfer roller 28*a*, the static charge removal device 26*a*, and the photoreceptor cleaning device 27*a* are arranged around the photoreceptor 22*a*. The photoreceptor 22*a* is formed with an aluminum (Al) tube, and a stacked organic photoreceptor including: an undercoat layer; a charge generation layer; and a charge transport layer having a thickness of about 30 μm, sequentially stacked on the Al tube.

The charging roller 23*a* is a contact charging device and is in contact with the photoreceptor 22*a*. The charging roller 23*a* is driven to rotate to follow the rotation of the photoreceptor 22*a*. The charging roller 23*a* includes a metal core formed of a metal and a conductive rubber layer formed on the metal core. The charging roller 23*a* may have a multilayer structure in which a plurality of layers is formed as a conductive rubber layer. The charging roller 23*a* has an electric resistance of $1\times10^4\Omega$ to $1\times10^8\Omega$.

The exposure apparatus 24*a* is provided under the photoreceptor 22*a*. The static charge removal device 26*a* is formed of a light emitting diode (LED) or the like. The photoreceptor cleaning device 27*a* is constantly pressed against the photoreceptor 22*a*.

The image forming unit 20*b* for M includes a photoreceptor 22*b*, a charging roller 23*b*, an exposure apparatus 24*b*, a developing apparatus 25*b*, a static charge removal device 26*b*, a photoreceptor cleaning device 27*b*, and a primary transfer roller 28*b*. The image forming unit 20*c* for C includes a photoreceptor 22*c*, a charging roller 23*c*, an exposure apparatus 24*c*, a developing apparatus 25*c*, a static charge removal device 26*c*, a photoreceptor cleaning device 27*c*, and a primary transfer roller 28*c*. The image forming unit 20*d* for K includes a photoreceptor 22*d*, a charging roller 23*d*, an exposure apparatus 24*d*, a developing apparatus 25*d*, a static charge removal device 26*d*, a photoreceptor cleaning device 27*d*, and a primary transfer roller 28*d*. Each of the image forming units 20*b*, 20*c*, and 20*d* has a similar configuration as the image forming unit 20*a*, and performs similar operation as the image forming unit 20*a*.

The intermediate transfer member 21 is a belt and is provided above the image forming units 20*a*, 20*b*, 20*c*, and 20*d* of colors of Y M, C, and K, respectively. The intermediate transfer member 21 is annular, and is disposed across a rotating roller 21*a*. The intermediate transfer member 21 is rotationally driven in a direction indicated by an arrow β in FIG. 1. The intermediate transfer member 21 is formed of a semiconductive material in which carbon is dispersed in a main raw material formed of polycarbonate, polytetrafluoroethylene (PTFE), or polyimide.

Each of the primary transfer rollers 28*a*, 28*b*, 28*c*, and 28*d* respectively faces each of the photoreceptors 22*a*, 22*b*, 22*c*, and 22*d* with the intermediate transfer member 21 interposed therebetween. The secondary transfer roller 29 is in contact with the intermediate transfer member 21 in the conveyance path TR. An interval between the secondary transfer roller 29 and the intermediate transfer member 21 can be adjusted by a pressure contact and separation mechanism (not illustrated). The intermediate transfer member cleaning device 30 is constantly pressed against the intermediate transfer member 21.

The fixing apparatus 40 grips and conveys a sheet SH carrying a toner image along the conveyance path TR so as to fix a toner image onto the sheet SH.

The operation panel 41 displays various types of information and receives various operation inputs.

The temperature and humidity sensor 42 detects the temperature and the humidity inside the image forming apparatus 1 and outputs results to the control unit 60.

The bias power supply 50 supplies electric power to each of members of the image forming apparatus 1 under the control of the control unit 60.

The control unit 60 controls overall operation of the image forming apparatus 1. The control unit 60 includes a central processing unit (CPU) that executes a control program, a read only memory (ROM) that stores the control program or the like, and a random access memory (RAM) constituting a work area of the CPU.

The image forming apparatus 1 rotates the photoreceptor 22*a* to evenly charge the surface of the photoreceptor 22*a* with the charging roller 23*a*. The photoreceptor 22*a* is charged to − (negative) 600 V, for example. The image forming apparatus 1 applies a charging voltage to the metal core of the charging roller 23*a* to cause a discharge between the photoreceptor 22*a* and the charging roller 23*a* so as to charge the photoreceptor 22*a*. The voltage to be used as a charging voltage may be the voltage obtained by superimposing an AC voltage on a DC voltage, or a DC voltage alone.

The image forming apparatus 1 causes the exposure apparatus 24*a* to perform exposure onto the surface of the charged photoreceptor 22*a* in accordance with image formation information of Y so as to form an electrostatic latent image of Y on the surface of the photoreceptor 22*a*.

Next, the image forming apparatus 1 supplies toner from the developing apparatus 25*a* to the photoreceptor 22*a* on which an electrostatic latent image is formed, so as to perform development to form a toner image of Y on the surface of the photoreceptor 22*a*. A developer used for development is a two-component developer containing a toner and a carrier. Moreover, at the time of development, a developing voltage obtained by superimposing an AC voltage having a frequency of 1.5 kHz and a peak voltage value Vpp of −400 V on a voltage value Vdc of DC voltage of −400 V is applied to a sleeve of the developing apparatus 25*a*.

Next, the image forming apparatus 1 uses the primary transfer roller 28*a* to transfer the toner image of Y formed on the photoreceptor 22*a* to the surface of the intermediate transfer member 21 (primary transfer). At the time of the transfer, a primary transfer bias is applied to the primary transfer roller 28*a*, leading to formation of a transfer electric field, which works to transfer the toner image to the intermediate transfer member 21.

After the primary transfer, the image forming apparatus 1 removes the charges remaining on the photoreceptor 22*a* by using the static charge removal device 26*a*, and removes toner remaining on the photoreceptor 22*a* without being transferred to the intermediate transfer member 21 by the photoreceptor cleaning device 27*a*. By removal of the charges remaining on the photoreceptor 22*a* by the static charge removal device 26*a*, it is possible to evenly lower the potential of the photoreceptor 22*a* to about −10V, leading to enhancement of the uniformity of charging.

Normally, static charge removal processing by the static charge removal device 26*a* is performed after the cleaning processing performed by the photoreceptor cleaning device 27*a* and before the charging processing performed by the charging roller 23*a*. However, in order to effectively utilize the space and to improve cleaning property, the static charge removal processing by the static charge removal device 26*a* may be performed after the primary transfer and before the cleaning processing performed by the photoreceptor cleaning device 27*a*. In this case, the static charge removal device 26*a* may be disposed between the primary transfer roller 28*a* and the photoreceptor cleaning device 27*a* as illustrated in FIG. 1.

The image forming apparatus 1 sequentially transfers toner images of M, C, and K to the surface of the intermediate transfer member 21 by respectively using the image forming units 20*b*, 20*c*, and 20*d*, similarly to the method for the toner image of Y. Each of the image forming units 20*b*, 20*c*, and 20*d* operates in synchronization with each other so that a toner image obtained by combining toner images of respective colors of Y, M, C, and K is superimposed on the surface of the intermediate transfer member 21.

Subsequently, the image forming apparatus 1 uses the rotating roller 21*a* to convey the toner image formed on the surface of the intermediate transfer member 21 to a position facing the secondary transfer roller 29.

Meanwhile, the image forming apparatus 1 uses the sheet feed roller 12 to feed the sheet SH accommodated in the sheet feed tray 11, and uses each of the plurality of conveyance rollers 13 to guide the sheet SH to a portion between the intermediate transfer member 21 and the secondary transfer roller 29 along the conveyance path TR. Then, the image forming apparatus 1 uses the secondary transfer roller 29 to transfer the toner image formed on the surface of the intermediate transfer member 21 to the sheet SH. After the secondary transfer, the image forming apparatus 1 uses the intermediate transfer member cleaning device 30 to remove the toner remaining on the intermediate transfer member 21 without being transferred to the sheet SH.

The image forming apparatus 1 guides the sheet SH onto which the toner image is transferred to the fixing apparatus 40, and fixes the toner image onto the sheet SH by the fixing apparatus 40. Thereafter, the image forming apparatus 1 uses the sheet discharge roller 14 to discharge the sheet SH on which the toner image has been fixed to the sheet discharge tray 15.

Subsequently, a control configuration of the charging roller in a certain image forming unit among the image forming units 20*a*, 20*b*, 20*c*, and 20*d* will be described. In the following description, the photoreceptor and the charging roller in a certain image forming unit are sometimes referred to as the photoreceptor 22 (an example of an image carrier) and the charging roller 23 (an example of a charging roller), respectively.

Figure 2:
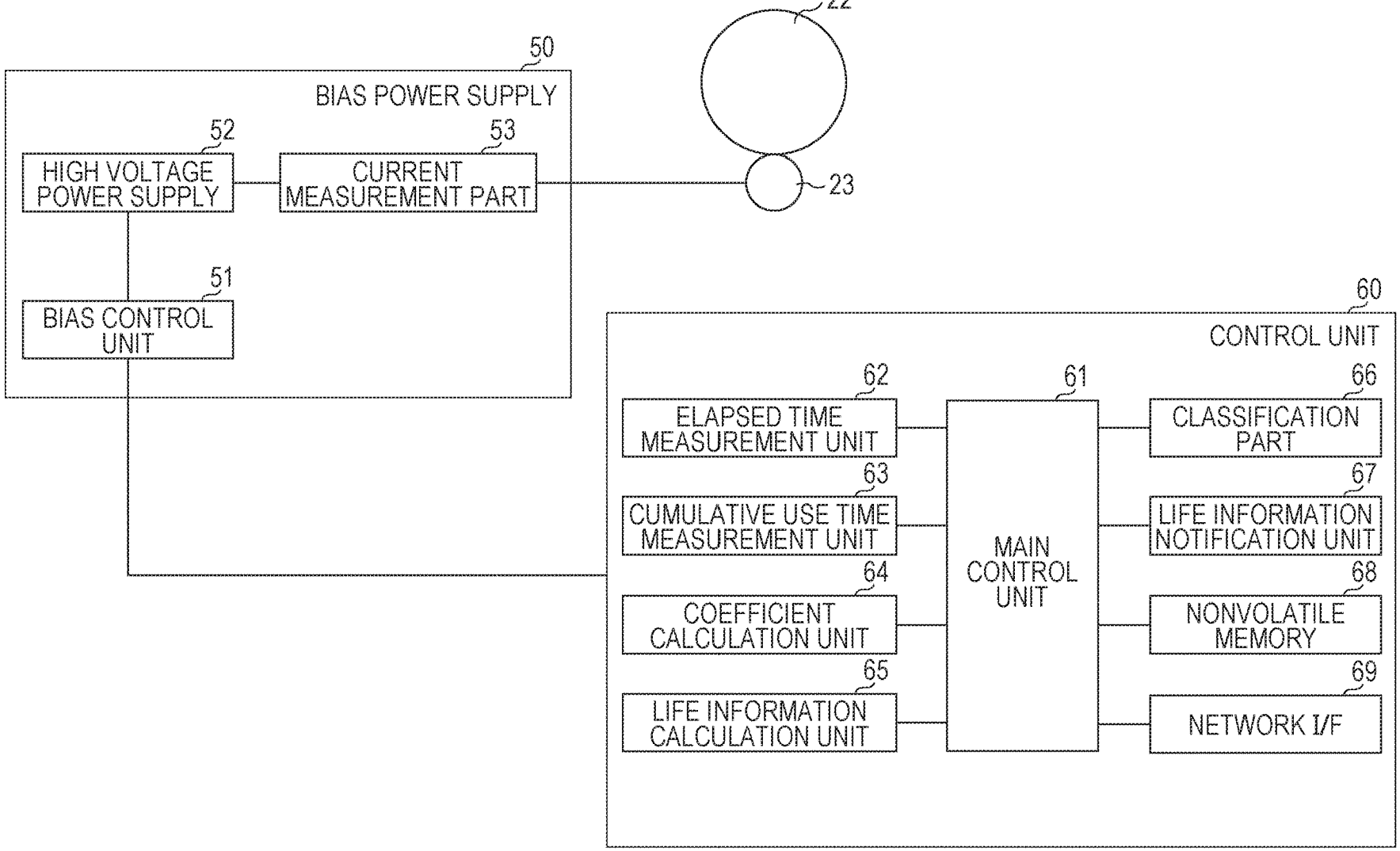
FIG. 2 is a block diagram illustrating a control configuration of a charging roller according to the first embodiment of the present invention.

FIG. 2 is a block diagram illustrating a control configuration of the charging roller 23 in a first embodiment of the present invention.

Referring to FIG. 2, the bias power supply 50 includes a bias control unit 51, a high voltage power supply 52 (exemplary power supply part), and a current measurement part 53 (exemplary current measurement part).

The bias control unit 51 controls a charging voltage applied by the high voltage power supply 52 under the control of the control unit 60.

The high voltage power supply 52 applies a charging voltage to the charging roller 23. The high voltage power supply 52 may apply a charging voltage including simply a DC component, or a charging voltage obtained by superimposing an AC component on a DC component. The high voltage power supply 52 may apply a charging voltage obtained by superimposing an AC component on a DC component at ordinary image formation and may apply a charging voltage including the DC component alone during life detection operation or life prediction operation described below.

The current measurement part 53 measures a value of a DC component of a discharge current flowing between the photoreceptor 22 and the charging roller 23 (hereinafter sometimes referred to as a DC current value) and outputs the value to the control unit 60, at necessary timings.

The control unit 60 includes a main control unit 61, an elapsed time measurement unit 62 (an example of a time measurement unit), a cumulative use time measurement unit 63, a coefficient calculation unit 64 (an example of a calculation unit), a life information calculation unit 65 (an example of a judgment unit), a classification part 66, a life information notification unit 67 (an example of a notification unit), a nonvolatile memory 68 (an example of a storage), and a network interface 69 (an example of a transmitter, a result receiver, and a function receiver).

The main control unit 61 controls overall operation of the image forming apparatus 1.

The elapsed time measurement unit 62 measures the elapsed time from the start of application of the charging voltage by the high voltage power supply 52.

The cumulative use time measurement unit 63 measures use amount information that is information related to the use amount of the charging roller 23. The use amount information is represented herein by the cumulative rotation number of the charging roller 23 and may preferably be information including at least any one of: a cumulative running distance of the charging roller 23, a cumulative rotation number of the charging roller 23, a cumulative rotation time of the charging roller 23, and a cumulative number of printed sheets of the image forming apparatus 1.

The coefficient calculation unit 64 calculates a coefficient of an approximate expression indicating the relationship between the value of the DC component of the current flowing between the photoreceptor 22 and the charging roller 23 and the elapsed time from the start of application of the charging voltage by the high voltage power supply 52.

The life information calculation unit 65 makes a judgment related to the life of the charging roller 23 on the basis of the coefficient calculated by the coefficient calculation unit 64 and a predetermined threshold BX described below.

The classification part 66 classifies history information described below into groups.

The life information notification unit 67 notifies a judgment result related to the life of the charging roller 23 by the life information calculation unit 65.

The nonvolatile memory 68 stores various types of information.

The network interface 69 communicates with an external device through a network.

Subsequently, operation (life detection operation) of detecting the end of life of the charging roller 23 performed by the image forming apparatus 1 in the present embodiment will be described.

Figure 3:
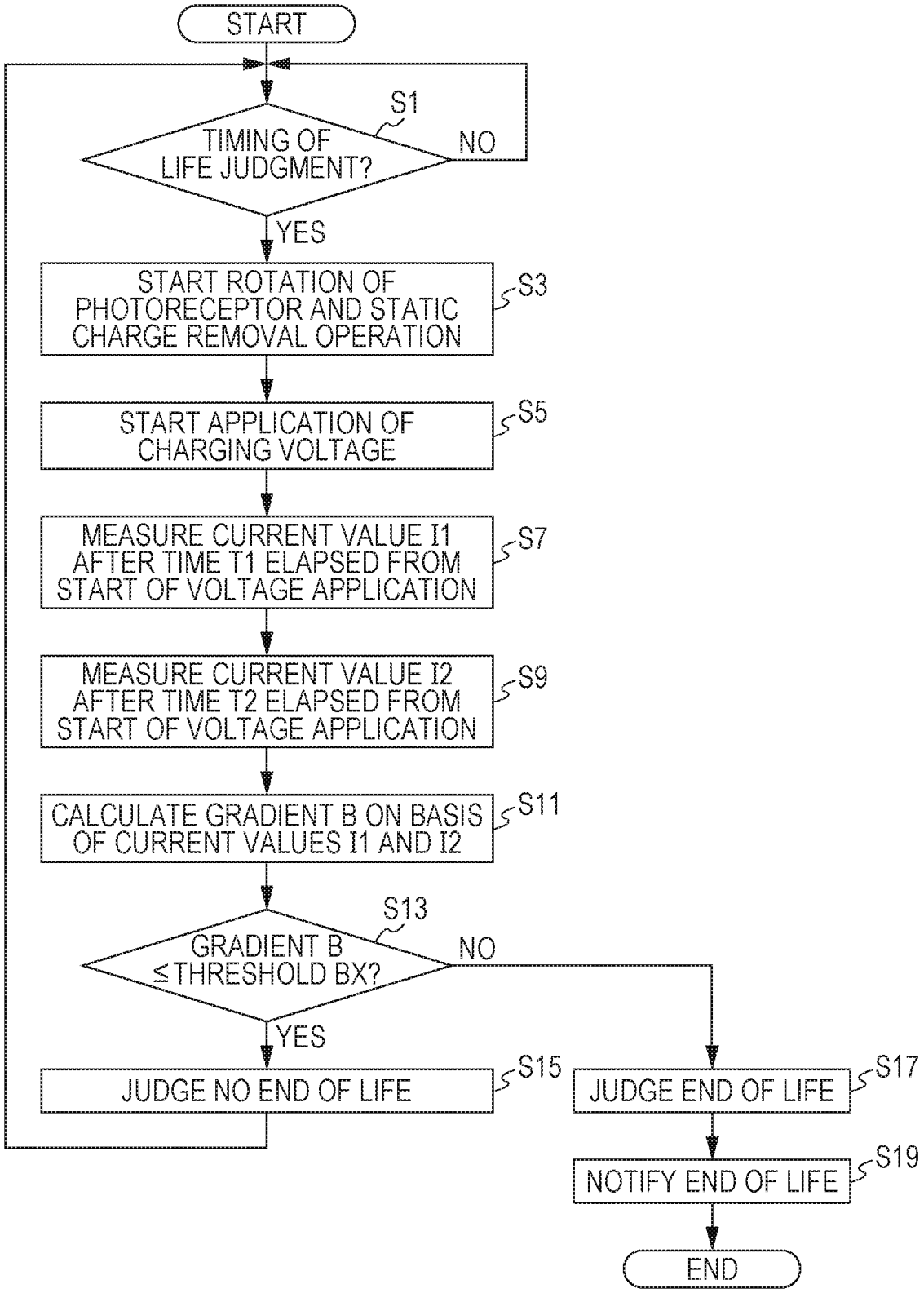
FIG. 3 is a flowchart illustrating life detection operation of the charging roller performed by the image forming apparatus in the first embodiment of the present invention.

FIG. 3 is a flowchart illustrating life detection operation of the charging roller 23 performed by the image firming apparatus 1 in the first embodiment of the present invention.

Referring to FIG. 3, the control unit 60 executes a life detection mode of the charging roller 23 at a predetermined timing (YES in S1). Examples of the predetermined timing include: a timing at which the number of printed sheets of the image forming apparatus 1 reaches a predetermined number of sheets; a timing at which the cumulative rotation number of the charging roller 23 reaches a predetermined rotation number; a timing at which the power of the image forming apparatus 1 is turned on; a timing at which the image forming apparatus 1 performs the image stabilization processing; or a timing at which the image forming apparatus 1 controls a peak voltage of an AC component in the charging voltage.

The control unit 60 starts rotational driving of the photoreceptor 22 and static charge removal operation on the static charge removal devices 26*a*, 26*b*, 26*c*, and 26*d* (S3). The control unit 60 starts applying the charging voltage to the charging roller 23 after a predetermined time from the start of rotational driving of the photoreceptor 22 (for example, after the photoreceptor 22 has undergone static charge removal for one rotation). The elapsed time measurement unit 62 starts measurement of the elapsed time from the start of applying the charging voltage (S5).

In Step S5, the surface potential V0 of the photoreceptor 22 generated by charging may be any value, and thus, the charging voltage may be any value. As the charging voltage, for example, it is allowable to use a charging voltage including a DC component of −1200 V alone. Alternatively, as the charging voltage, it is allowable to use a charging voltage in which an AC component (peak voltage value Vpp: 2 kV) is superimposed on a DC component (for example, a voltage value Vdc: −600 V). Moreover, it is also allowable to estimate the film thickness of the photoreceptor 22 on the basis of the cumulative running distance of the photoreceptor 22 and this estimated thickness may be used as a basis of correction of the value of the charging voltage so that the surface potential V0 of the photoreceptor 22 becomes a substantially constant value. In particular, in the use of a charging voltage including the DC component alone, since the charging current depends on the potential difference before and after charging, it is necessary to operate a static charge removal member so that the potential of the photoreceptor 22 before charging becomes constant. It is sufficient as long as the potential before charging is constant during one DC current value measurement (during a series of measurement modes, measured two or more times with different times).

During the measurement of the DC current value, the charging voltage is preferably corrected such that the surface potential V0 becomes a substantially constant value in the case of using a charge voltage obtained by superimposing an AC component on a DC component and such that the surface potential V0 becomes a substantially constant value in the case of using a charge voltage including the DC component alone. However, in the present embodiment, since the charging performance of the charging roller 23 is judged on the basis of the temporal change of the DC current value, the charging voltage may be any value. The image forming apparatus 1 need not activate the exposure apparatuses 24*a*, 24*b*, 24*c*, and 24*d*, the developing apparatuses 25*a*, 25*b*, 25*c*, and 25*d*, a transfer device (a primary transfer roller 28*a*, 28*b*, 28*c*, and 28*d*, the secondary transfer roller 29), or the like, at the time of life detection operation or life prediction operation of the charging roller 23.

Subsequently, the control unit 60 measures a DC current value I1 (S7) at the timing when time T1 has elapsed since the application of a charging voltage, and measures a DC current value I2 (S9) at a timing when time T2 (T2>T1) has elapsed from the start of the application of the charging voltage. As an example, the time T1 is 0.1 (s) and the time T2 is 0.6 (s). Subsequently, the control unit 60 calculates a gradient B which is a coefficient of an approximate expression illustrating a relationship between the DC current value and the elapsed time (S11) on the basis of the DC current values I1 and I2 and the times T1 and T2.

Figure 4:
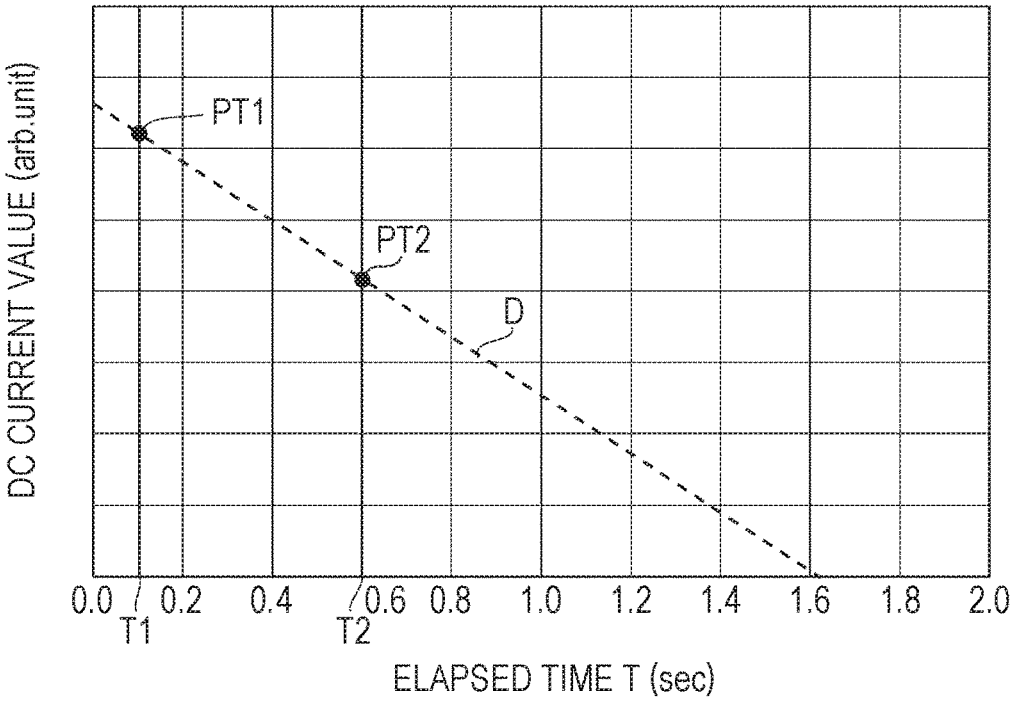
FIG. 4 is a diagram schematically illustrating details of processing of step S11 in FIG. 3.

FIG. 4 is a diagram schematically illustrating details of the processing of step S11 in FIG. 3.

Referring to FIG. 4, in step S11, the control unit 60 plots a point PT1 corresponding to the DC current value I1 and a point PT2 corresponding to the DC current value I2 on a biaxial coordinate with the horizontal axis indicating the elapsed time from the start of applying the charging voltage and the vertical axis indicating the DC current value. Then, the control unit 60 calculates the gradient B of a straight line D connecting the plotted two points.

Figure 5:
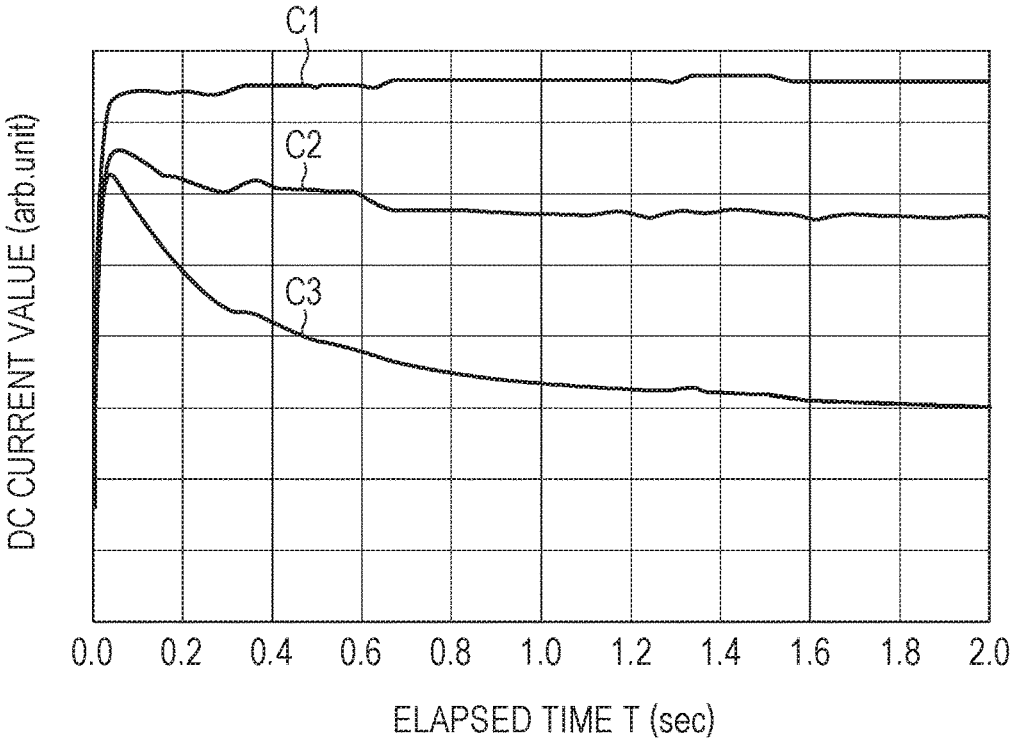
FIG. 5 is a diagram illustrating a relationship between the elapsed time from the start of application of a charging voltage and a DC current value.

FIG. 5 is a diagram illustrating a relationship between the elapsed time from the start of application of a charging voltage and a DC current value.

With reference to FIG. 5, the inventors of the present invention have found the following facts. The DC current value decreases together with the elapsed time from the start of application of the charging voltage and eventually converges to a constant value. The lower the surface potential of the photoreceptor 22, the greater the decreasing amount of the current within a certain period of time immediately after start of the application of the charging voltage, that is, the decreasing amount does not depend on the film thickness of the photoreceptor 22. Specifically, the relationship between the elapsed time from the start of the application of the charging voltage and the DC current value indicates a behavior indicated by a curve C1 in a case where the charging roller 23 is brand new, and the curve changes from the curve C1 to a curve C2, and to a curve C3 together with an increase of the use period of the charging roller 23.

The gradient B calculated in step S11 indicates the rate of reduction of the current immediately after the start of the application of the charging voltage. This indicates that the larger the absolute value of the gradient B, the lower the charging performance (charge supply capability) of the charging roller 23.

The gradient B is a coefficient of an approximate expression representing the relationship between the DC current value and the elapsed time from the start of the application of the charging voltage, and is an example of a coefficient calculated by the control unit 60. While the approximate expression used here is a linear expression, the approximate expression may be any expression, and may be k (k is an integer of 2 or greater)-degree polynomial, an exponential function, a logarithmic function, or the like. Moreover, it is sufficient that the DC current value used for calculating the coefficients of the approximate expression be measured at least at two timings with different elapsed times and may be measured at three or more timings with mutually different elapsed times.

As described above, the DC current value decreases with an increase in the elapsed time from the start of applying the charging voltage, and thus, the actual value of the gradient B is a negative value. However, in the hollowing description, a value obtained by multiplying the actual value of the gradient B by −1 (absolute value of the gradient B) will be treated as gradient B for convenience of explanation.

Referring again to FIG. 3, the control unit 60 next compares the calculated gradient with the threshold BX of the gradient B and judges whether the charging roller 23 has reached the end of life. The control unit 60 discriminates whether the gradient B is the threshold BX or less (S13). The threshold BX is calculated experimentally beforehand and stored in the nonvolatile memory 68.

In a case where it is discriminated that the gradient B is the threshold BX or less in step S13 (YES in step S13), the control unit 60 judges that the charging roller 23 has not reached the end of life (step S15), and the processing proceeds to step S1.

In a case where it is discriminated in step S13 that the gradient B is greater than the threshold BX (NO in step S15), the control unit 60 judges that the charging roller 23 has reached its end of life (S17), and uses a method of displaying an alert on the operation panel 41, or the like, to notify that the charging roller 23 has reached the end of life (S19), and then finishes the processing.

Note that the control unit 60 holds a plurality of the thresholds BX and may change the stage of alert to the user each time the gradient B reaches each of the plurality of thresholds BX. Moreover, the control unit 60 may notify the user of the use amount of the charging roller 23, the remaining use amount of the charging roller 23, the replacement announcement of the charging roller 23, a replacement instruction of the charging roller 23 in accordance with the relationship between the gradient B and the threshold BX. Furthermore, in a case where it is judged that the charging roller 23 has reached the end of life, the control unit 60 may stop the operation of the image forming apparatus 1 until the charging roller 23 is replaced.

In the present embodiment, the life of the charging roller 23 is judged on the basis of the coefficient of the approximate expression (the dependence of the DC current value on the application time) illustrating the relationship between the DC current value and the elapsed time from the start of the application of the charging voltage. Since the coefficient of this approximate expression is not affected by the film thickness of the photoreceptor 22, it is possible to enhance the judgment accuracy of the life of the charging roller. In addition, there is no need to bring the conductive member for measuring the current flowing through the charging roller 23 into contact with the charging roller 23 at the time of judging the life of the charging roller 23. This makes it possible to simplify the configuration for detecting the life of the charging roller 23, leading to suppression of enlargement of the image forming apparatus.

Second Embodiment

In the present embodiment, operation of predicting the life (life prediction operation) of the charging roller 23 performed by the image forming apparatus 1 on the basis of the use amount information (here, cumulative rotation numbers of the charging roller 23) and a coefficient of the approximate expression will be described.

Figure 6:
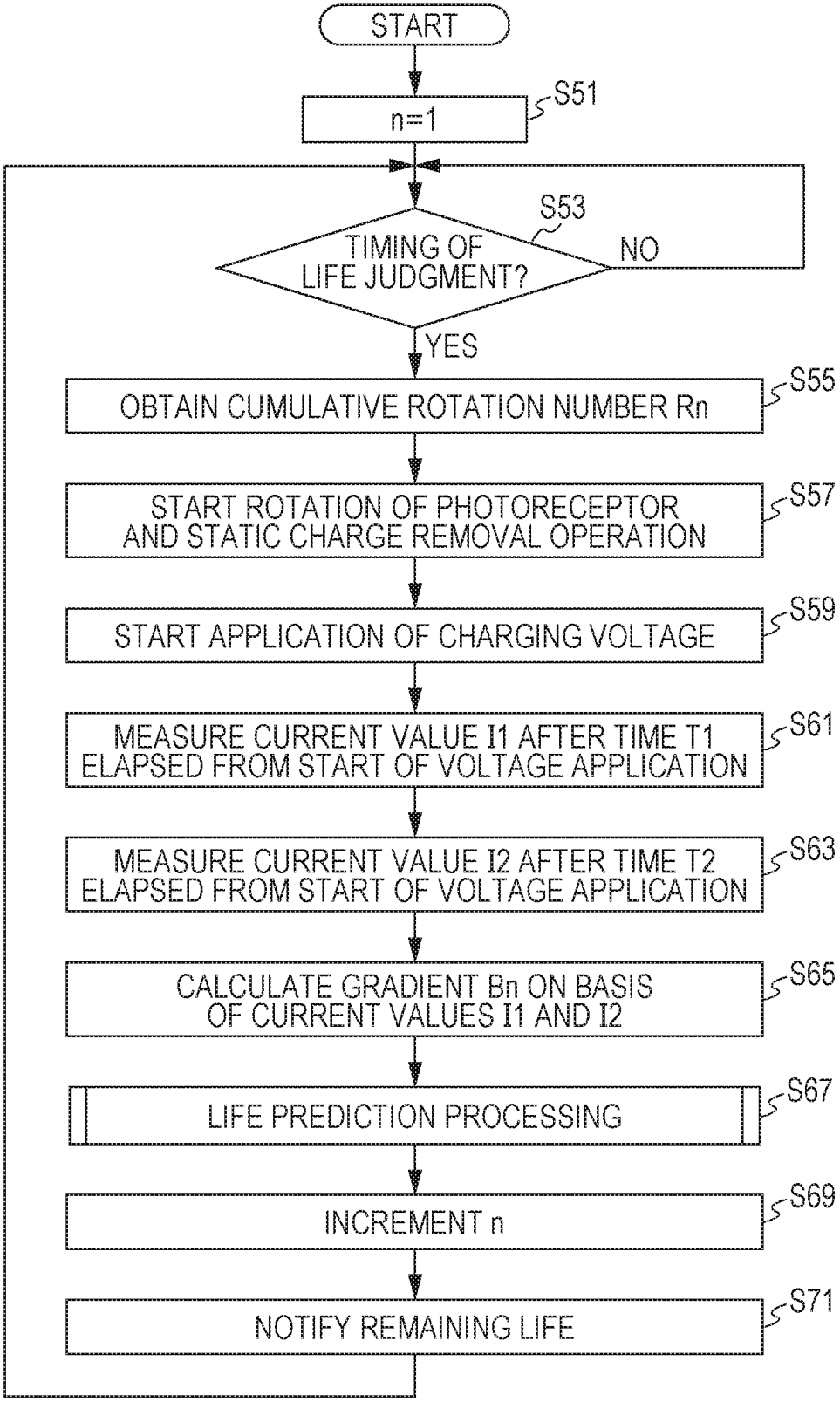
FIG. 6 is a flowchart illustrating life prediction operation of the charging roller performed by the image forming apparatus in a second embodiment of the present invention.

FIG. 6 is a flowchart illustrating life prediction operation of the charging roller 23 performed by the image forming apparatus 1 in the second embodiment of the present invention.

Referring to FIG. 6, the control unit 60 sets a variable n to 1 (S51), and executes a life prediction mode of the charging roller 23 at a predetermined timing (YES in S53). The control unit 60 obtains a cumulative rotation number Rn of the charging roller 23 (S55). The cumulative rotation numbers Rn represents the cumulative rotation numbers R of the charging roller 23 obtained at the n-th time. Next, the control unit 60 starts rotation driving of the photoreceptor 22 and static charge removal operation of the static charge removal devices 26*a*, 26*b*, 26*c*, and 26*d* (S57), and starts applying a charging voltage to the charging roller 23 (S59). Subsequently, the control unit 60 measures a DC current value I1 (S61) at the timing when time T1 has elapsed from the application of a charging voltage, and measures a DC current value I2 (S63) at a timing when time T2 (T2>T1) has elapsed from the start of the application of the charging voltage. Subsequently, the control unit 60 calculates a gradient Bn on the basis of the DC current values I1 and I2 (S65) and performs life prediction processing (S67) for predicting the life of the charging roller 23. The gradient Bn represents the gradient B calculated at the n-th time. Subsequently, the control unit 60 increments the variable n (S69) and notifies the user of the remaining life of the charging roller 23 by a method such as displaying remaining life on the operation panel 41 (S71), and the processing proceeds to the processing of step S53.

Figure 7:
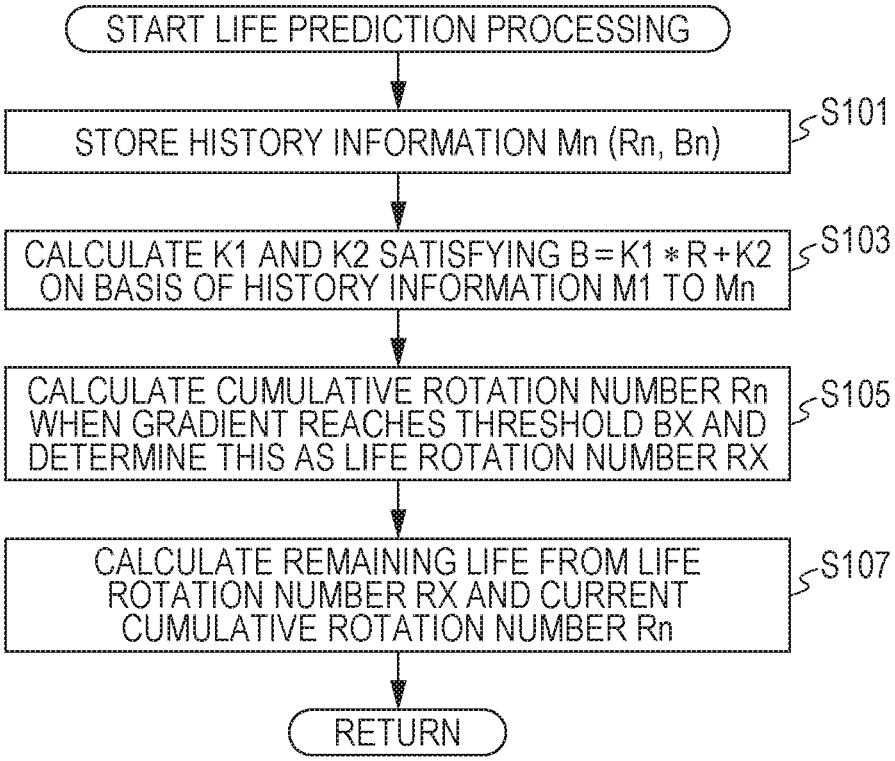
FIG. 7 is a subroutine of the life prediction processing (step S67 in FIG. 6) according to the second embodiment of the present invention.
Figure 8:
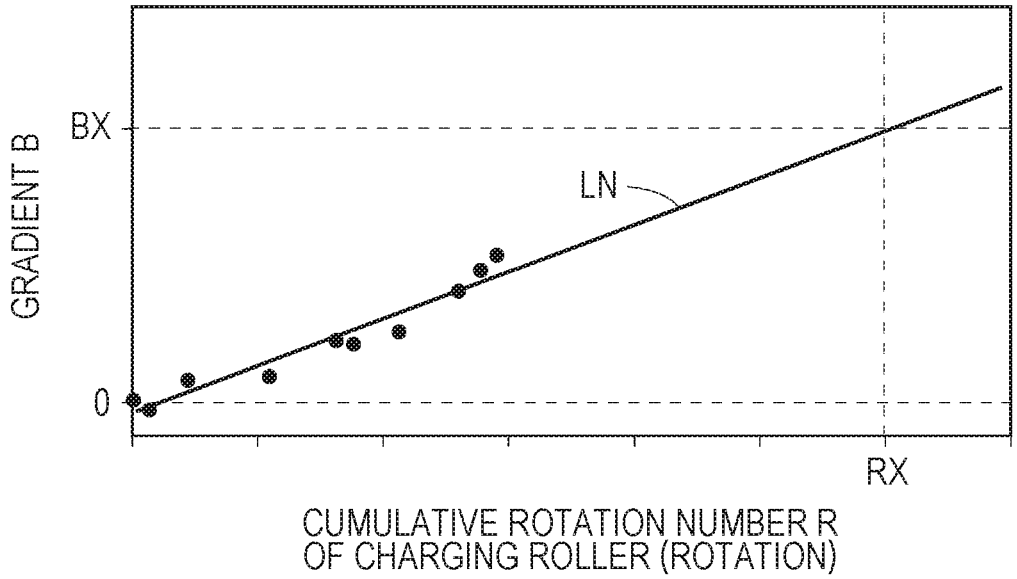
FIG. 8 is a diagram schematically illustrating a life prediction method according to the second embodiment of the present invention.

FIG. 7 is a subroutine of the life prediction processing (step S67 in FIG. 6) in the second embodiment of the present invention. FIG. 8 is a diagram schematically illustrating a life prediction method according to the second embodiment of the present invention.

Referring to FIG. 7, in the life prediction processing of step S67, the control unit 60 associates the obtained cumulative rotation numbers Rn of the charging roller 23 and the calculated gradient Bn with each other and stores the associated information as history information Mn (Rn, Bn) in the nonvolatile memory 68 (S101). The nonvolatile memory 68 accumulates the history information M stored in the past. The history information Mn represents history information M stored at the n-th time.

Subsequently, the control unit 60 calculates constants K1 and K2 satisfying the following formula (3) (S103) on the basis of the history information M1 to Mn stored in the nonvolatile memory 68.

$$B=K1\times R+K2 \quad (3)$$

In step S103, as illustrated in FIG. 8, the control unit 60 plots history information M1 to Mn on biaxial coordinates with the cumulative rotation numbers R of the charging roller 23 on the horizontal axis and the gradient B on the vertical axis. The control unit 60 uses a least-square method to derive an approximate expression LN approximating the relationship between the cumulative rotation numbers R of the charging roller 23 and the gradient B so as to calculate the constants K1 and K2. Note that the approximate expression approximating the relationship between the cumulative rotation numbers R of the charging roller 23 and the gradient B need not be a linear equation, hut may be any formula.

Subsequently, the control unit 60 calculates the cumulative rotation number R of the charging roller 23 when the gradient B reaches the threshold BX (an example of the threshold for the gradient) in the approximate expression LN, and determines the calculated cumulative rotation number R as a life rotation number RX which is predicted cumulative rotation number at which the charging roller 23 is expected to reach the end of life (S105). Next, the control unit 60 calculates a difference between the life rotation number RX and the cumulative rotation number Rn of the charging roller 23 obtained in step S55 to calculate the predicted remaining life of the charging roller 23 (S107) and executes RETURN.

It is sufficient as long as the control unit 60 can predict the life of the charging roller 23. Therefore, in addition to the cumulative rotation numbers at which the charging roller 23 reaches the end of life, the control unit 60 may predict a cumulative running distance by which the charging roller 23 reaches the end of life, a cumulative rotation time at which the charging roller 23 reaches the end of life, the cumulative number of printed sheets of the image forming apparatus 1 at which the charging roller 23 reaches the end of life, or the like.

The control unit 60 may notify the user of the extent of wear of the charging roller 23, the remaining life of the charging roller 23, the replacement alert of the charging roller 23, or the like, in accordance with the calculated remaining life. Furthermore, in a case where the calculated remaining life is 0 or less, the control unit 60 may stop operation of the image forming apparatus 1 until the charging roller 23 is replaced.

The configuration and operation of the image forming apparatus 1 other than those described above are similar to the configurations and operation of the image forming apparatuses in the first and second embodiments, and thus description thereof will not be repeated.

According to the present embodiment, it is possible to grasp the predicted timing at which the charging roller 23 reaches its end of life, leading to enhancement of the convenience of the image forming apparatus.

Third Embodiment

Depending on the type of the charging roller 23, the DC current value of the discharge current might vary due to the influence of the state of the image forming apparatus 1 (temperature and humidity in the image forming apparatus 1, an operation history of the image thrilling apparatus 1, a pause history of the image forming apparatus 1, or the like). The present embodiment will focus on the humidity inside the image forming apparatus 1 as the state of the image forming apparatus 1.

Figure 9:
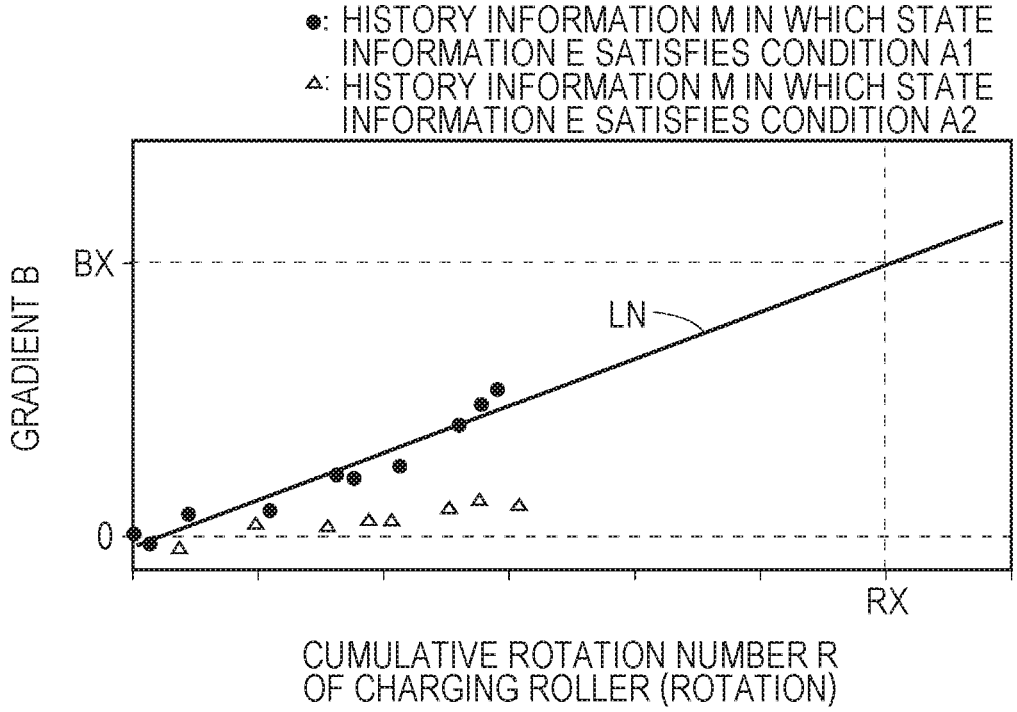
FIG. 9 is a diagram schematically illustrating a life prediction method according to a third embodiment of the present invention.

FIG. 9 is a diagram schematically illustrating a life prediction method according to the third embodiment of the present invention.

Referring to FIG. 9, the history information M1 to Mn is classified into two groups, namely, a group (solid circles in FIG. 9) and a group (hollow triangles in FIG. 9) in which the humidity (state information E described below) of the image forming apparatus 1 satisfies a condition A1 and a condition A2, respectively. The condition A1 is a condition that the absolute humidity in the image forming apparatus 1 is in a range of 5 g/m$^2$ or more and 15 g/m$^2$ or less. The condition A2 is a condition that the absolute humidity inside the image forming apparatus 1 is 20 g/m$^2$ or more.

Under a high humidity environment, discharge current easily flows between the photoreceptor 22 and the charging roller 23, leading to suppression of deterioration of the charging performance of the charging roller 23. Therefore, deriving an approximate expression by using both the plot belonging to the group of the condition A1 which is a usual condition and the plot belonging to the group of the condition A2 which is a high humidity condition might deteriorate the accuracy of the approximate expression and might deteriorate the prediction accuracy of the remaining life of the charging roller 23.

To avoid this situation, the image forming apparatus 1 according to the present embodiment predicts life of the charging roller 23 on the basis of history information in which state information being information indicating the state of the image forming apparatus 1 satisfies a predetermined condition among history information stored in the nonvolatile memory 68.

The image forming apparatus 1 of the present embodiment performs the following operation in the life prediction processing in FIG. 6 (step S67 in FIG. 6).

Figure 10:
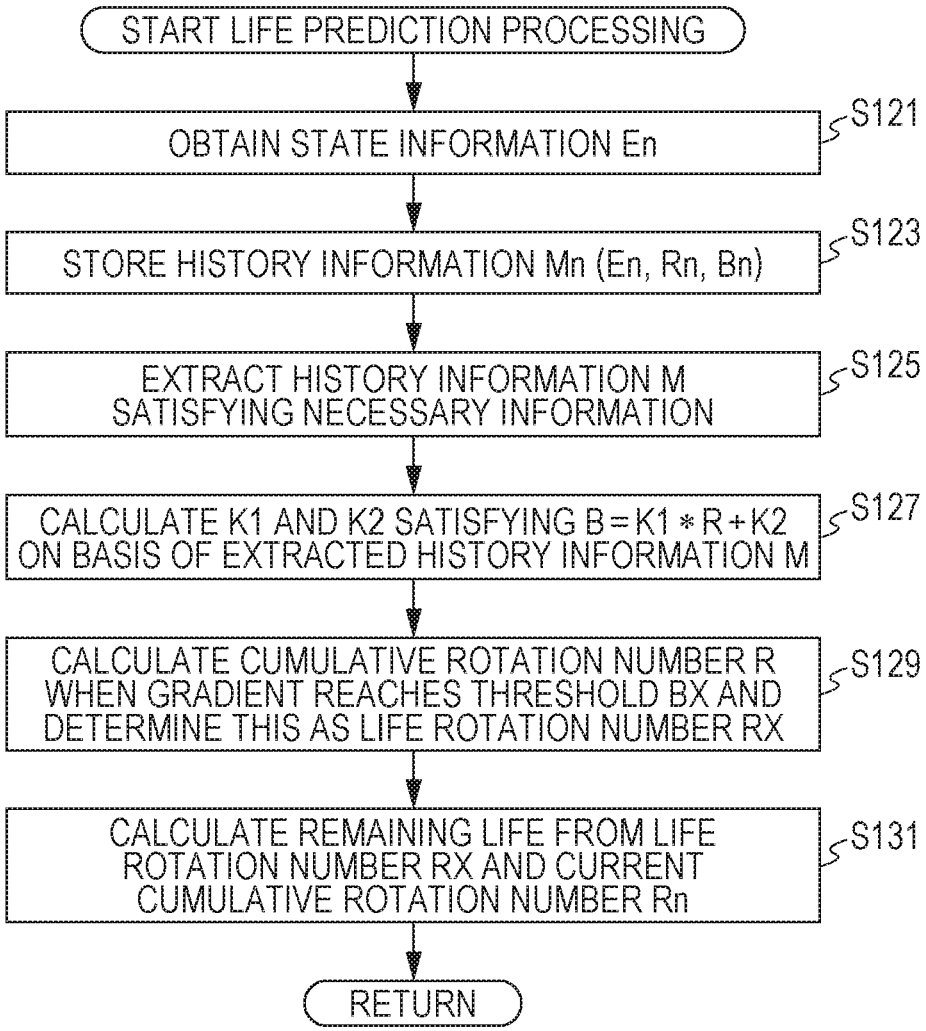
FIG. 10 is a subroutine of life prediction processing (step S67 in FIG. 6) according to a third embodiment of the present invention.

FIG. 10 is a subroutine of the remaining life prediction processing (step S67 in FIG. 6) in the third embodiment of the present invention.

Referring to FIGS. 9 and 10, the control unit 60 obtains state information En being information indicating the state of the image forming apparatus 1 in the life prediction processing of step S67 (S121).

The state information preferably includes at least one of the temperature in the image forming apparatus 1, the humidity of the image forming apparatus 1 (in other words, the environment of the image forming apparatus 1), the operation history of the image forming apparatus 1, and the pause history of the image forming apparatus 1. The state information is typically the humidity in the image forming apparatus 1 detected by the temperature and humidity sensor 42. Note that the state information En represents state information E stored at the n-th time.

Subsequently, the control unit 60 associates the obtained state information En with the obtained cumulative rotation number Rn of the charging roller 23 and the calculated gradient Bn with each other and stores as history information Mn (En, Rn, and Bn) in the nonvolatile memory 68 (S123). The nonvolatile memory 68 accumulates the history information M stored in the past.

Subsequently, the control unit 60 extracts history information M (solid circle in FIG. 9) satisfying a predetermined condition (for example, the above condition A1) (an example of necessary conditions) from the history information M1 to Mn stored in the nonvolatile memory 68) (S125). The control unit 60 next uses the extracted history information M as a basis to derive an approximate expression LN (FIG. 9) approximating the relationship between the cumulative rotation numbers R of the charging roller 23 and the gradient B so as to calculate the constants K1 and K2 satisfying Formula (3) (S127).

Next, the control unit 60 calculates the cumulative rotation number R of the charging roller 23 when the gradient B reaches the threshold BX in the approximate expression LN, and determines the calculated cumulative rotation number R as a life rotation number RX which is the predicted cumulative rotation number at which the charging roller 23 is expected to reach the end of life (S129). Next, the control unit 60 calculates a difference between the life rotation number RX and the cumulative rotation number Rn of the charging roller 23 obtained in step S55 to calculate the predicted remaining life of the charging roller 23 (S131) and executes RETURN.

The configuration and operation of the image forming apparatus 1 other than those described above are similar to the configurations and operation of the image forming apparatuses in the first and second embodiments, and thus description thereof will not be repeated.

According to the present embodiment, the timing at which the charging roller 23 reaches the end of life is predicted on the basis of the history information including appropriate environmental information, making it possible to enhance life prediction accuracy.

Fourth Embodiment

The image forming apparatus 1 according to the present embodiment classifies the history information stored in the nonvolatile memory 68 into a plurality of groups and predicts the life of the charging roller 23 for each of the plurality of groups on the basis of the history information in the group. The image forming apparatus 1 determines the life of the charging roller 23 on the basis of the predicted life of the charging roller 23 obtained for each of the plurality of groups.

The image forming apparatus 1 of the present embodiment performs the following operation in the life prediction processing in FIG. 6 (step S67 in FIG. 6).

Figure 11:
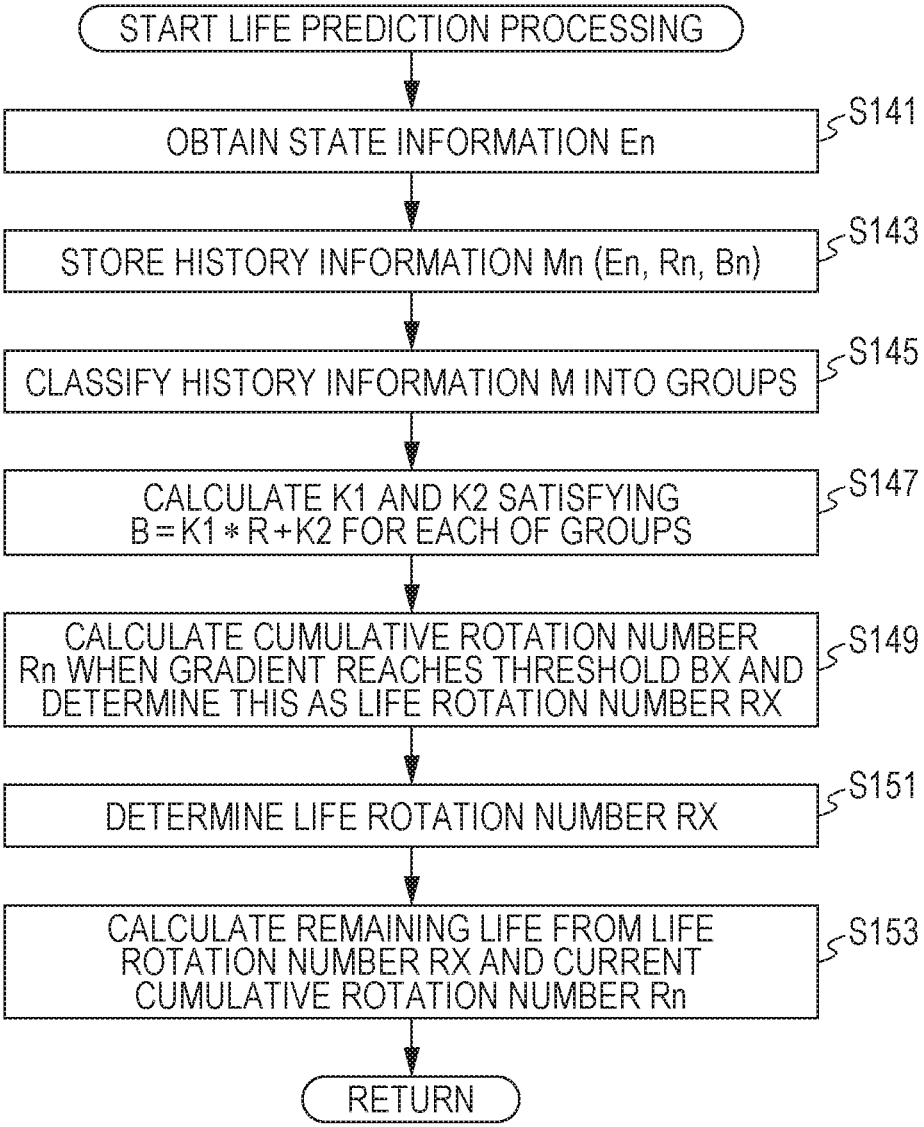
FIG. 11 is a subroutine of life prediction processing (step S67 in FIG. 6) according to a fourth embodiment of the present invention.
Figure 12:
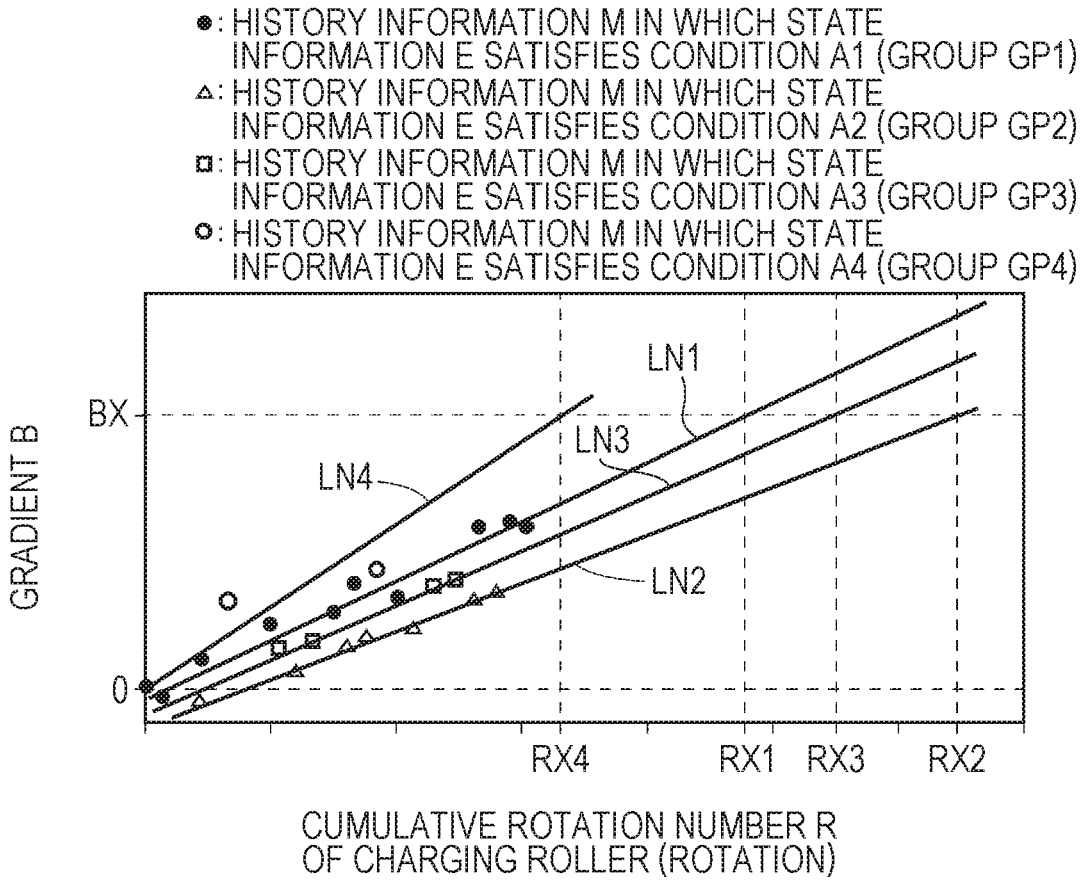
FIG. 12 is a diagram schematically illustrating a life prediction method according to the fourth embodiment of the present invention.

FIG. 11 is a subroutine of the remaining life prediction processing (step S67 in FIG. 6) in a fourth embodiment of the present invention. FIG. 12 is a diagram schematically illustrating a life prediction method according to the fourth embodiment of the present invention.

Referring to FIGS. 11 and 12, the control unit 60 obtains state information En being information indicating the state of the image forming apparatus 1 in the life prediction processing of step S67 (S141). Subsequently, the control unit 60 associates the obtained state information En with the obtained cumulative rotation number Rn of the charging roller 23 and the calculated gradient Bn with each other and stores as history information Mn (En, Rn, and Bn) in the nonvolatile memory 68 (S143). The nonvolatile memory 68 accumulates the history information M stored in the past.

Next, as illustrated in FIG. 12, the control unit 60 classifies the history information M stored in the nonvolatile memory 68 into a plurality (four in this case) of groups GP1 GP2, GP3, and GP4 on the basis of the state information F included in the history information M (S145). The group GP1 is a group of history information M in which the state information E satisfies the condition A1. The group GP2 is a group of history information M in which the state information E satisfies the condition A2. The group GP3 is a group of history information M in which the state information F satisfies the condition A3. The group GP4 is a group of history information M in which the state information E satisfies the condition A4. Each of the conditions A1, A2, A3, and A4 is different from each other.

Subsequently, the control unit 60 predicts the life of the charging roller 23 for each of the plurality of groups GP1, GP2, GP3, and GP4 on the basis of the history information M within the group. The control unit 60 uses the history information M in each of the plurality of groups GP1, GP2, GP3, and GP4 as a basis to derive each of approximate expressions LN1, LN2, LN3, and LN4 approximating a relationship between the cumulative rotation number R of the charging roller 23 and the gradient B, so as to calculate the constants K1 and K2 satisfying Formula (3) (S147). The approximate expression LN1 is an approximate expression derived on the basis of the history information M in the group GP1. The approximate expression LN2 is an approximate expression derived on the basis of the history information M in the group GP2. The approximate expression LN3 is an approximate expression derived on the basis of the history information M in the group GP3. The approximate expression LN4 is an approximate expression derived on the basis of the history information M in the group GP4.

Next, the control unit 60 calculates the cumulative rotation number R of the charging roller 23 when the gradient B reaches the threshold BX in each of the approximate expressions LN1, LN2, LN3, and LN4, and determines the calculated cumulative rotation number R as a life rotation number RX1, RX2, RX3, and RX4, respectively, which is the predicted cumulative rotation number at which the charging roller 23 is expected to reach the end of life (S149). The life rotation number RX1 is a life rotation number of the group GP1 calculated from the approximate expression LN1. The life rotation number RX2 is a life rotation number of the group GP2 calculated from the approximate expression LN2. The life rotation number RX3 is a life rotation number of the group GP3 calculated from the approximate expression LN3. The life rotation number RX4 is a life rotation number of the group GP4 calculated from the approximate expression LN4.

Subsequently, the control unit 60 determines the life rotation number RX of the charging roller 23 on the basis of the predicted life rotation numbers RX1, RX2, RX3, and RX4 of the charging roller 23 for each of the plurality of groups GP1, GP2, GP3, and GP4 (S151).

In step S151, the control unit 60 may determine the shortest life rotation number (life rotation number RX4 in FIG. 12) out of the life rotation numbers RX1, RX2, RX3, and RX4, as the life rotation number RX.

Furthermore, in step S151, the control unit 60 may determine the life rotation number (life rotation number RX1 in FIG. 12) of the group having the greatest number of pieces of history information belonging to the group, as the life rotation number RX.

In step S151, the control unit 60 may arrange the groups GP1, GP2, GP3, and GP4 in descending order of the number of pieces of history information belonging to the group, and may extract a group having an order of arrangement higher than the center (groups GP1 and GP2 in FIG. 12), and may determine the shortest life rotation number (life rotation number RX1 in FIG. 12) among the life rotation numbers RX1 and RX2 of the extracted groups GP1 and GP2, as the life rotation number RX.

Alternatively, in step S151, the control unit 60 may exclude those whose history information belonging to the group does not reach a predetermined number (group GP4 in FIG. 12), and may determine the shortest life rotation number (the life rotation number RX1 in FIG. 12) among the life rotation numbers RX1, RX2 and RX3 of the remaining groups GP1, GP2, and GP3, as the life rotation number RX.

Still alternatively, in step S151, the control unit 60 may exclude an approximate expression including a predetermined ratio or more plots in which the deviation from the approximate expression is a predetermined degree or more, out of the approximate expressions LN1, LN2, LN3, and LN4 (LN4 in FIG. 12), and may determine the shortest life rotation number (life rotation number RX1 in FIG. 12) out of the life rotation numbers RX1, RX2, and RX3 calculated from each of the remaining approximate expressions LN1, LN2, and LN3, as the life rotation number RX.

Subsequently, the control unit 60 calculates a difference between the life rotation number RX determined and the cumulative rotation number Rn of the charging roller 23 obtained in step S55 to calculate the predicted remaining life of the charging roller 23 (S153) and executes RETURN.

The configuration and operation of the image forming apparatus 1 other than those described above are similar to the configurations and operation of the image forming apparatuses in the first and second embodiments, and thus description thereof will not be repeated.

According to the present embodiment, it is possible to avoid a situation where the life prediction is performed by adopting a DC current value in a case where the image forming apparatus 1 is in an unusual state. As a result, it is possible to predict the life suitable for the state of the image forming apparatus 1, and possible to avoid a situation where the life of the charging roller 23 is predicted to be excessively short.

Fifth Embodiment

In a case where history information in which the state information satisfies a predetermined condition is extracted and life prediction of the charging roller 23 is performed on the basis of the extracted history information as in the third embodiment, the stricter the condition, the less the number of pieces of extracted history information, leading to greater error of the prediction result. In addition, in a case where the history information is grouped to calculate the life of the charging roller 23 as in the fourth embodiment, the finer the grouping, the less the error due to the state of the image forming apparatus 1 while the greater the prediction result error due to the reduced number of pieces of history information belonging to the group.

Therefore, the image forming apparatus 1 according to the present embodiment uses history information accumulated in the data center 2 (an example of an external device) connected via a network to judge the life of the charging roller 23.

Figure 13A:
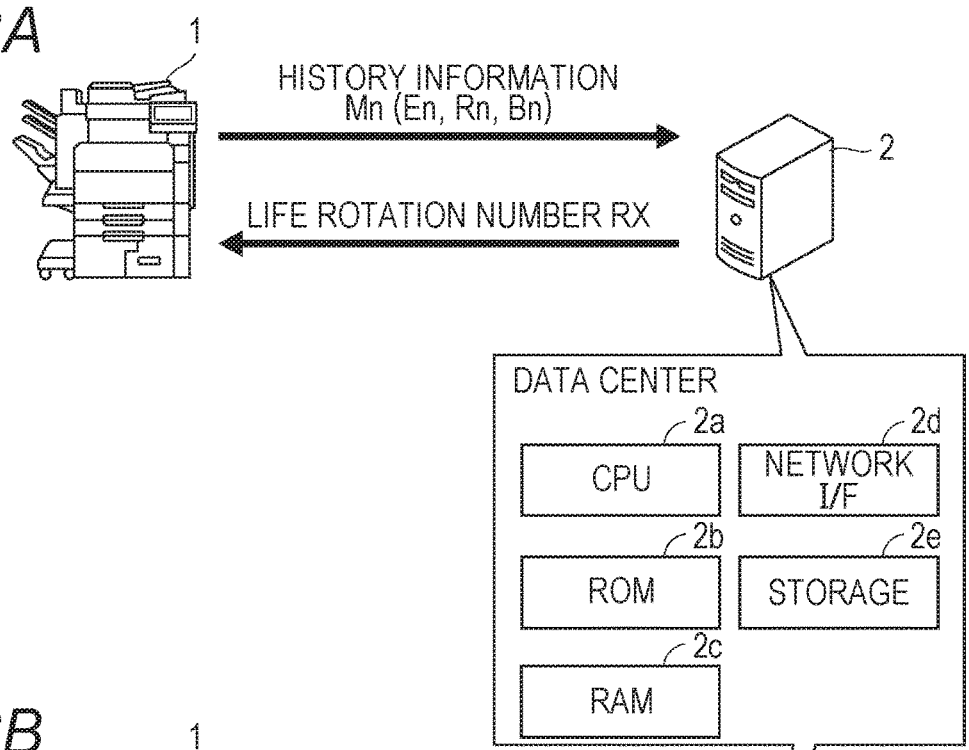
FIGS. 13A and 13B are diagrams schematically illustrating a use mode of a data center according to a fifth embodiment of the present invention.
Figure 13B:
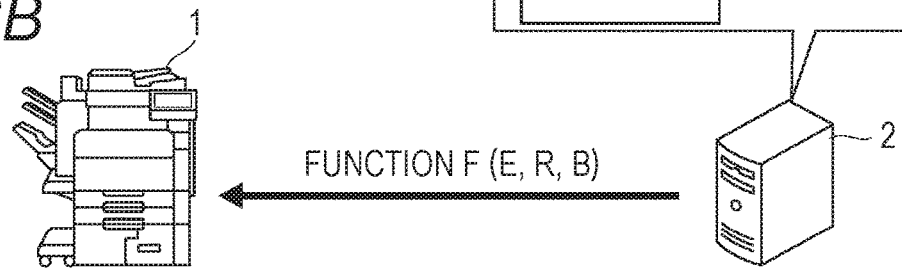

FIGS. 13A and 13B are diagrams schematically illustrating use modes of the data center 2 according to the fifth embodiment of the present invention. FIG. 13A illustrates a first example of a use mode, and FIG. 13B illustrates a second example of a use mode.

The premise of the first and second examples will be described with reference to FIGS. 13A and 13B. The image forming apparatus 1 can communicate with the data center 2. The data center 2 includes a CPU 2*a* that executes a control program, a ROM 2*b* that stores a control program or the like, a RAM 2*c* that forms a work area of the CPU 2*a*, a network interface 2*d* provided for performing communication through a network, and a storage 2*e* that stores various types of information.

The data center 2 collects history information M (E, R, and B) from a plurality of devices including the image forming apparatus 1 at a predetermined timing, and accumulates the collected history information M in the storage 2*c*. The data center 2 calculates a function F (E, R, B) (an example of a life function) on the basis of the collected history information M at a predetermined timing. The function F (E, R, B) is a function for calculating the gradient B on the basis of the state information E and the cumulative rotation number R. The data center 2 stores the function F (E, R, B) in the storage 2*e*.

The image forming apparatus 1 of the first example performs the following operation in the life prediction processing in FIG. 6 (step S67 in FIG. 6).

Figure 14:
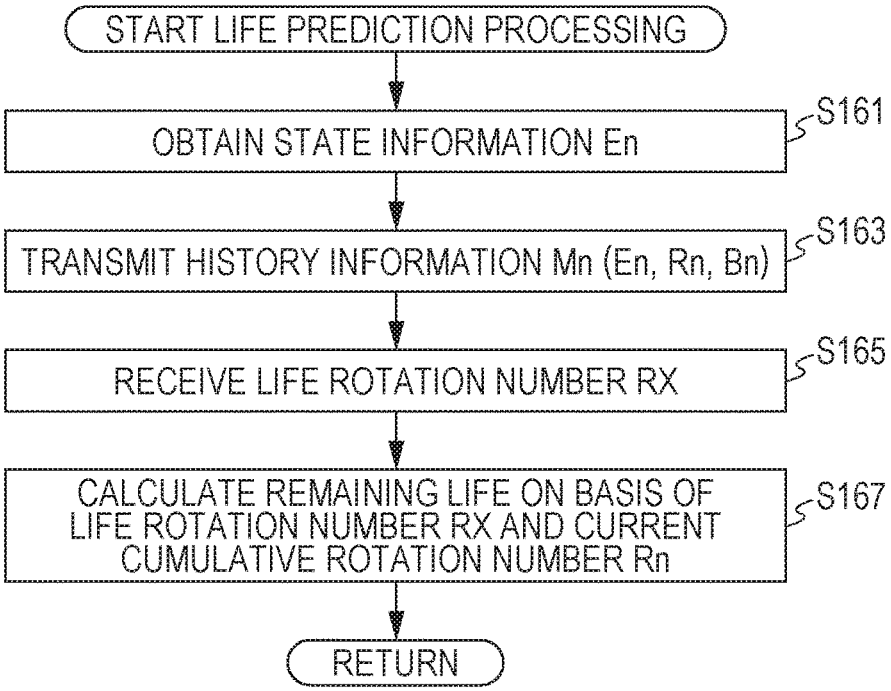
FIG. 14 is a subroutine of life prediction processing (step S67 in FIG. 6) in a first example of the fifth embodiment of the present invention.

FIG. 14 is a subroutine of life prediction processing (step S67 in FIG. 6) in a first example of the fifth embodiment of the present invention.

Referring to FIGS. 13A and 14, the control unit 60 obtains state information En being information indicating the state of the image forming apparatus 1 in the life prediction processing of step S67 (S161). Next, the control unit 60 associates the obtained state information En with the obtained cumulative rotation number Rn of the charging roller 23 and the calculated gradient Bn with each other and transmits as history information Mn (En, Rn, and Bn) to the data center 2 (S163). The history information Mn transmitted in step S163 may further include information specific to the image forming apparatus 1, such as the installation location of the image forming apparatus 1.

After receiving the history information Mn, the data center 2 updates the function F (E, R, B) on the basis of the received history information Mn and the history information M already collected. The data center 2 calculates the service life rotation number RX using the function F (E, R, B) on the basis of the history information Mn, and transmits the service life rotation number RX to the image forming apparatus 1. After receiving the service life rotation number RX (S165), the control unit 60 calculates a difference between the received life rotation number RX and the cumulative rotation number Rn of the charging roller 23 obtained in step S55 to calculate the predicted remaining life of the charging roller 23 (S167), and executes RETURN.

Sometimes due to concentrated processing on the data center 2, there is a case where calculation of the life rotation number RX can be performed with higher efficiency with the image forming apparatus 1 than calculated by the data center 2 as illustrated in the first example. In consideration of such a case, in the second example, the function F is transmitted beforehand from the data center 2 to the image forming apparatus 1 at a necessary timing, and the image forming apparatus 1 holds the received function F. The image forming apparatus 1 of the second example performs the following operation in the life prediction processing in FIG. 6 (step S67 in FIG. 6), FIG. 15 is a subroutine of the life prediction processing (step S67 in FIG. 6) in the second example of the fifth embodiment of the present invention.

Figure 15:
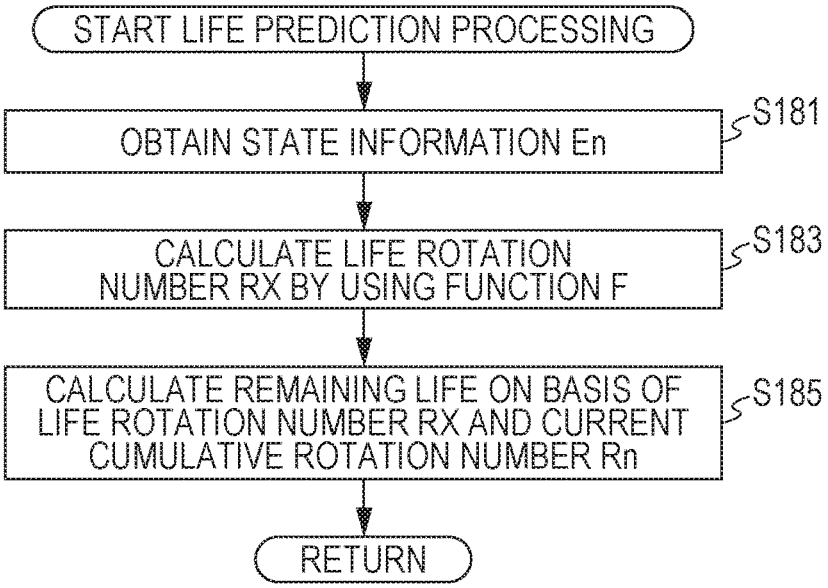
FIG. 15 is a subroutine of life prediction processing (step S67 in FIG. 6) in a second example of embodiment of the present invention.
Figure 16:
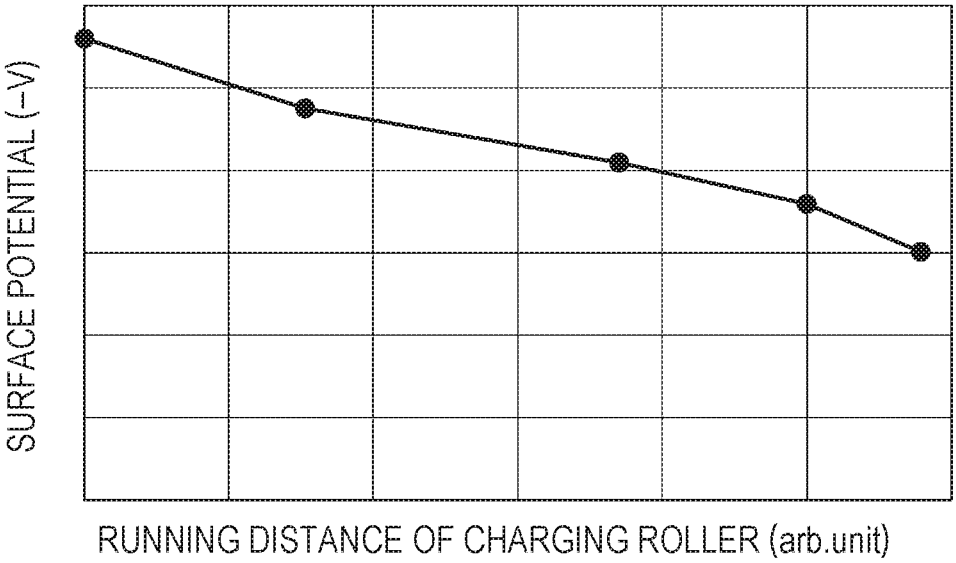
FIG. 16 is a diagram schematically illustrating a relationship between a running distance of a charging roller and a surface potential of a photoreceptor in a case where a charging voltage applied to the charging roller is constant.

Referring to FIGS. 13B and 15, the control unit 60 obtains state information En being information indicating the state of the image forming apparatus 1 in the life prediction processing of step S67 (S181). Next, the control unit 60 associates the obtained state information En with the obtained cumulative rotation numbers Rn of the charging roller 23 and the calculated gradient Bn with each other to be defined as history information Mn, and calculate the life rotation number RX by using the function F (E, R, B) held beforehand on the basis of the history information Mn (S183), Subsequently, the control unit 60 calculates a difference between the calculated life rotation number RX and the cumulative rotation number Rn of the charging roller 23 obtained in step S55 to calculate the predicted remaining life of the charging roller 23 (S185) and executes RETURN.

The configuration and operation of the image forming apparatus 1 other than those described above are similar to the configurations and operation of the image forming apparatuses in the first and second embodiments, and thus description thereof will not be repeated.

According to the present embodiment, the life of the charging roller 23 is predicted on the basis of a large number of pieces of history information collected by the data center 2, making it possible to enhance the life prediction accuracy.

Others

The above-described embodiments can be combined with each other.

The processing in the above-described embodiments may be performed by software or may be performed using a hardware circuit. Furthermore, it is also possible to provide a program for executing the processing in the above-described embodiments, and the program may be recorded on a recording medium such as a CD-ROM, a flexible disk, a hard disk, a ROM, a RAM, a memory card and supplied to the user. The program is executed by a computer such as a CPU. Furthermore, the program may be downloaded to the apparatus via a communication line such as the Internet.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

an image carrier;

a charging roller that charges the image carrier;

a power supply part that applies a charging voltage to the charging roller;

a current measurement part that measures a value of a DC component of a current flowing between the image carrier and the charging roller at at least two timings having mutually different elapsed times; and a hardware processor that measures an elapsed time from a start of application of the charging voltage by the power supply part, calculates a coefficient which is a gradient of an approximate expression indicating a relationship between (i) the value of the DC component of the current flowing between the image carrier and the charging roller measured by the current measurement part at each of the at least two timings, and (ii) the elapsed time, and performs judgment related to an end of life of the charging roller based on a comparison between the coefficient and a predetermined threshold.

2. The image forming apparatus according to claim 1, wherein the hardware processor performs prediction of the end of life of the charging roller, the end of life of the charging roller being a timing at which the coefficient reaches the predetermined threshold, based on (i) use amount information related to a use amount of the charging roller and (ii) the coefficient.

3. The image forming apparatus according to claim 2, wherein the use amount information includes at least one of a cumulative running distance of the charging roller, a cumulative rotation number of the charging roller, a cumulative rotation time of the charging roller, and a cumulative number of printed sheets of the image forming apparatus.

4. The image forming apparatus according to claim 2, further comprising a state obtaining part that obtains state information related to a state of the image forming apparatus.

5. The image forming apparatus according to claim 4, wherein the state information includes at least one of a temperature in the image forming apparatus, a humidity in the image forming apparatus, an operation history of the image forming apparatus, and a pause history of the image forming apparatus.

6. The image forming apparatus according to claim 4, further comprising a storage that stores history information in which the use amount information, the coefficient, and the state information which are used at a time of judgment of the end of life of the charging roller in the past by the hardware processor are associated with each other.

7. The image forming apparatus according to claim 6, wherein the hardware processor predicts the end of life of the charging roller based on history information from among the history information stored in the storage in which the state information satisfies a necessary condition.

8. The image forming apparatus according to claim 6, wherein the hardware processor classifies the history information stored in the storage into a plurality of groups based on the state information, predicts the end of life of the charging roller for each of the plurality of groups based on the history information in the group, and determines the end of life of the charging roller based on the predicted end of life of the charging roller of each of the plurality of groups.

9. The image forming apparatus according to claim 8, wherein the hardware processor determines, as the end of life of the charging roller, one of (i) the predicted end of life of the charging roller that is shortest among the predicted end of life of the charging roller of each of the plurality of groups, and (ii) the predicted end of life of the charging roller of the group from among the plurality of groups having a largest number of pieces of the history information belonging to the group.

10. The image forming apparatus according to claim 4, the image forming apparatus being capable of communicating with an external device, and the image forming apparatus further comprising:

a transmitter that transmits the use amount information, the coefficient, and the state information to the external device in association with each other; and a result receiver that receives a judgment result related to the end of life of the charging roller from the external device, wherein the hardware processor predicts the end of life of the charging roller based on the judgment result received by the result receiver.

11. The image forming apparatus according to claim 4, the image forming apparatus being capable of communicating with an external device, and the image forming apparatus further comprising:

a function receiver that receives a life function that prescribes a relationship between the use amount information, the coefficient, and the state information, from the external device, wherein the hardware processor predicts the end of life of the charging roller by using the life function based on the use amount information, the coefficient, and the state information.

12. The image forming apparatus according to claim 1, wherein the hardware processor notifies a result of the judgment made by the hardware processor.

13. A method for controlling an image forming apparatus including an image carrier, a charging roller that charges the image carrier, and a power supply part that applies a charging voltage to the charging roller, the method comprising:

measuring an elapsed time from a start of application of the charging voltage by the power supply part;

measuring a value of a DC component of a current flowing between the image carrier and the charging roller at at least two timings having mutually different elapsed times;

calculating a coefficient which is a gradient of an approximate expression indicating a relationship between (i) the value of the DC component of the current flowing between the image carrier and the charging roller measured at each of the at least two timings, and (ii) the elapsed time; and performing judgment related to an end of life of the charging roller based on a comparison between the coefficient and a predetermined threshold.

14. A non-transitory recording medium storing a computer readable program for controlling an image forming apparatus including an image carrier, a charging roller that charges the image carrier, and a power supply part that applies a charging voltage to the charging roller, the program causing a computer to perform:

measuring an elapsed time from a start of application of the charging voltage by the power supply part;

measuring a value of a DC component of a current flowing between the image carrier and the charging roller at at least two timings having mutually different elapsed times;

calculating a coefficient which is a gradient of an approximate expression indicating a relationship between (i) the value of the DC component of the current flowing between the image carrier and the charging roller measured at each of the at least two timings, and (ii) the elapsed time; and performing judgment related to an end of life of the charging roller based on a comparison between the coefficient and a predetermined threshold.

* * * * *